US006635118B2

(12) United States Patent
Sachdev et al.

(10) Patent No.: US 6,635,118 B2
(45) Date of Patent: Oct. 21, 2003

(54) AQUEOUS CLEANING OF POLYMER APPLY EQUIPMENT

(75) Inventors: Harbans S. Sachdev, Hopewell Junction, NY (US); Richard A. Cormack, Hopewell Junction, NY (US); Gerard V. Capogna, Hyde Park, NY (US); Felice J. Mancaruso, Hopwell Junction, NY (US); Krishna Sachdev, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 122 days.

(21) Appl. No.: 09/765,015

(22) Filed: Jan. 17, 2001

(65) Prior Publication Data

US 2002/0094939 A1 Jul. 18, 2002

(51) Int. Cl.[7] ..... B08B 7/02

(52) U.S. Cl. ..... 134/1; 134/2; 134/26; 134/27; 134/28; 134/29; 134/38; 134/40; 134/902; 438/905; 510/175; 510/176; 510/178; 510/420; 510/421; 510/424; 510/425; 510/426; 510/427; 510/428; 510/435

(58) Field of Search ..... 134/1, 2, 29, 38, 134/40, 26, 27, 28, 902; 510/175, 176, 178, 421, 424, 425, 426, 427, 428, 435, 420; 438/905

(56) References Cited

U.S. PATENT DOCUMENTS

| | | | | | |
|---|---|---|---|---|---|
| 5,643,818 | A | * | 7/1997 | Sachdev et al. | 134/1 |
| 5,817,610 | A | * | 10/1998 | Honda et al. | 510/176 |
| 5,861,061 | A | * | 1/1999 | Hayes et al. | 118/52 |
| 5,888,308 | A | * | 3/1999 | Sachdev et al. | 134/1 |
| 5,908,661 | A | * | 6/1999 | Batcheldor et al. | 427/240 |
| 5,938,856 | A | * | 8/1999 | Sachdev et al. | 134/1.3 |
| 6,221,157 | B1 | * | 4/2001 | Davis et al. | 118/52 |
| 6,348,100 | B1 | * | 2/2002 | Cummings et al. | 134/1 |

* cited by examiner

*Primary Examiner*—Randy Gulakowski
*Assistant Examiner*—M. Kornakov
(74) *Attorney, Agent, or Firm*—James J. Cioffi

(57) ABSTRACT

This invention relates to water-based alkaline cleaning solutions and their use as an environmentally safer replacement of organic solvents to remove photoresist, polyimide residue and other interlevel dielectric polymer coating residue from polymer film apply equipment, specifically, spin coater bowl and assembly parts consisting of a teflon top shield, stainless steel plate, and a bottom teflon spin coating bowl used in semiconductor device fabrication processes.

35 Claims, 2 Drawing Sheets

CLEANING ASSEMBLY UNIT

AQUEOUS CLEANING OF POLYMER APPLY EQUIPMENT

BACKGROUND OF THE INVENTION

The present invention is directed to the aqueous cleaning of spin coating bowl assemblies employed in microelectronic fabrication processes. This invention is particularly concerned with the cleaning of photoresist, polyimide and other polymers from spin coating bowl assemblies with water based detergent compositions as an environmentally friendly replacement of organic solvents that are commonly used for cleaning photoresist and polyimide residue from polymer film application equipment. The invention is also applicable to cleaning low dielectric constant polymer dielectric residue from spin coating bowls and associated equipment for coatings on device wafers and on ceramic substrates.

In semiconductor device fabrications, formation of thin polymer films of photoresist, antireflective coatings, polyimide-polyamic acid precursor, and low dielectric constant polymer dielectric materials (low-k materials) such as Silk (Dow trade name), and siloxane based materials such as silsesquioxane and hydrogen silsesquioxane (HSQ) polymers on various substrates by the spin coating technique is an important part of the process sequence. Various solvents used in film coating formulations of these polymers include: propyleneglycol methylether acetate (PGMEA), cyclohexanone, ethoxyethyl propionate (EEP), ethyl lactate, methyl isobutyl ketone (MIBK), n-methylpyrrolidinone (NMP), gama-butyrolactone, aromatic hydrocarbons and mixture thereof. The spin coating equipment includes a coating bowl assembly made of a machined teflon top shield, a stainless steel plate, and a bottom teflon bowl. The substrate, silicon wafer or ceramic substrate to be coated is positioned on a vacuum chuck in the center of the bowl where it is held in place by vacuum during spinning. A small volume of the polymer solution is dispensed in the center of the substrate and spun at a pre-determined spin speed and time duration. In this operation, excess polymer solution which may be a photoresist, typically comprising a phenolic resin of the type novolak or poly (p-hydroxystyrene) as matrix resins and a photoactive compound, acid-amplified resists, antireflective coating formulation, polyimide-polyamic acid coating formulation, or low-k polymer materials, splashes against the inside walls of the spin coating bowl and other assembly parts. Although most of the excess polymer drains into a receptacle from where it is later removed, a fraction of the splashed material remains adhered to the spin coater walls and associated assembly parts. With repeated use of the spin coating bowl assembly, the polymer builds up inside the coater bowl and the assembly parts to several hundred microns which, if not removed, can flake off causing contamination on the film surface, film defects and consequently product yield loss. Therefore, it is essential to clean the spin coating bowl assembly every 100 to 200 hours of use to prevent the possibility of film defects caused by falling debris of dry polymer residue.

At present, throughout the microelectronic industry, the resist coating bowls and associated equipment are cleaned with organic solvents, typically, 1-methyl-2-pyrrolidinone (NMP), n-butyl acetate (nBA), acetone, isopropanol (IPA), methyl isobutylketone (MIBK) and dimethylacetamide (DMAC). As such organic solvents may present environmental problems, it is necessary to install specialized abatement equipment to control air emissions. In addition to environmental problems, IPA, nBA, MIBK and acetone are highly flammable solvents having flash point<100° F. and thus present a fire hazard, which requires costly explosion-proof equipment for their use.

There are a number of methods proposed by others for the stripping and cleaning of photoresist and polyimide residues. Nishi, Japanese Patent number 08104895, the disclosure of which is incorporated by reference herein, discloses the use of diacetone alcohol for cleaning photoresist based on quinonediazide-novolak.

Sugyama, Japanese Patent number 08165495, the disclosure of which is incorporated by reference herein, discloses a solvent system comprising a mixture of 1-methyl-2-pyrrolidinone and/or N, N-dimethylacetamide, and alkylene glycol monoalkyl ethers for cleaning polyimide precursor residues in semiconductor manufacturing.

Walsh et al. U.S. Pat. No. 5,698,045, the disclosure of which is incorporated by reference herein, discloses a method for removing polymer residue from chemical processing equipment according to which the contaminated surface is exposed to vapors of NMP such that the vapors from the boiling solvent condense on the polymer surface causing the polymer to flake-off.

Notwithstanding the prior art, major problems with the cleaning solvents for photoresist and polyimide residues disclosed in the art are chemical safety, and environmental concerns. Thus, a purpose of the present invention is to have a method for providing suitable water-based cleaning alternatives along with the necessary cleaning equipment for aqueous cleaning processes.

Accordingly, it is a purpose of this invention to provide an environmentally friendly water-based cleaning method for cleaning polymer residues of photoresist, antireflective coatings, siloxane containing polymers, polyimide, spin-on low k interlevel dielectric polymer and the like from spin coating bowl assemblies and replace organic solvents such as NMP, IPA, acetone, nBA, MIBK, diacetone alcohol etc., which are traditionally used for cleaning polymer residue from various surfaces in semiconductor device manufacturing.

It is another purpose of this invention to provide water-based detergent formulations for spin coater bowl assembly cleaning employing a combination of surfactants in conjunction with alkali, alkanolamine, and alkali metal salt of dibasic/polybasic organic acid.

It is another purpose of this invention to provide a polymer coater bowl cleaning unit assembly and method for spin coater bowl assembly cleaning with aqueous detergent formulations employing ultrasonic cleaning and a dishwasher rinse cycle.

It is another purpose of this invention to provide aqueous cleaning solutions for polymer processing equipment in semiconductor manufacturing using water solution of surface tension lowering agents in conjunction with alkali metal hydroxides, or tetraalkyammonium hydroxide, alkanolamine, and combinations thereof.

It is another purpose of this invention to provide a method for aqueous cleaning of spin coater bowl assembly and related polymer processing equipment.

It is another purpose of this invention to provide an aqueous cleaning method for polymer spin coating equipment using water-based alkaline solutions which have no problem of volatile air emissions, no chemical safety or flammability issues, and which does not require high cost cleaning equipment.

These and other purposes of the present invention will become more apparent after referring to the following description considered in conjunction with the accompanying drawings.

SUMMARY OF THE INVENTION

This invention is concerned with spin coater bowl assembly cleaning to remove polymer residue of photoresists, antireflective coatings, polyimide precursor coatings, and the low dielectric constant polymers from the spin coating bowl side walls and assembly parts. Particularly, this invention is concerned with replacement of NMP and flammable solvents with water-based cleaning solutions to provide an environmentally friendly option for cleaning spin coating bowl assemblies. This invention is especially concerned with aqueous alkaline cleaning compositions and method of using the same for cleaning polymer spin coating bowls and associated assembly parts to remove polymer residues from coating formulations of photoresists, antireflective coatings, acid-amplified resists, silicone-containing polymers, polyimide-precursor formulations, as well as spin-on low-k materials based on hydrogen silsesquioxane (HSQ), FOx flowable oxide, and related silsesquioxane polymers.

The inventors have discovered that water-based alkaline detergent solutions comprising a combination of surfactants in conjunction with alkanolamine, alkali metal hydroxide, and alkali metal carboxylate salt are highly effective in removing polymer residue, particularly, novolak-diazonaphthoquinone based photoresist, acid-amplified resist, silicone-containing polymers, and polyimide precursor residue from various surfaces including metal, teflon, PFA, polypropylene and other plastics. The aqueous cleaning compositions according to this invention typically comprise about 1% to about 10% (wt %) of active ingredients in water which include a surface active agent, preferably comprising a mixture of a non-ionic surfactant and an amphoteric surfactant and/or an ionic surfactant, alkanolamine, sodium hydroxide, potassium hydroxide, and/or a tetraalkyl ammonium hydroxide, alkali metal salt of a polybasic organic acid, and optionally a corrosion inhibitor. It is found that coater bowl cleaning can be readily effected by ultrasonic agitation in the aqueous alkaline cleaning solution comprising these components, heated to 120° F. to 150° F. or higher, if the polymer deposit is not dried out or by a static pre-soak followed by ultrasonic agitation in the case of heavy dried out polymer residue.

The water based alkaline detergent solution comprises at least one alkali metal hydroxide, at least one alkanolamine, at least one combination of a non-ionic surfactant and an amphoteric surfactant, and at least one salt of a polybasic organic acid, in water. The water based alkaline detergent solution comprises at least one tetraalkylammonium hydroxide, at least one alkanolamine, at least one combination of a non-ionic surfactant and an amphoteric surfactant, and at least one salt of a polybasic organic acid, in water.

The polymer residue is a low dielectric constant polymer coating formulation selected from the group consisting of silsesquioxane polymer, hydrogen silsesquioxane polymer, flowable oxide polymer and mixtures thereof The alkali metal hydroxide is selected from the group consisting of sodium hydroxide, potassium hydroxide, and mixtures thereof The tetraalkammonium hydroxide is selected from the group consisting of tetramethyl ammonium hydroxide, tetraethyl ammonium hydroxide, 2-hydroxyethyltrimethyl ammonium hydroxide, and mixture thereof the non-ionic surfactant is selected from the group consisting of ethoxylated alkyl phenols, poly (oxyethylene) dodecyl ether, biodegradable graft co-polymers from mono or oligosaccharides, glucosamides, and mixtures thereof the ethoxylated alkyl phenols are poly(oxyethylene-oxypropylene) nonylphenyl ether or ethoxylated alkyl phenols are poly(oxyethylene-oxypropylene) octylpheny ether. The amphoteric surfactant is selected from the group consisting of coco-imidopropyl betaine, sodium alkoxypropyl iminodipropionate, methylalkyl imidazoline sodium salt and mixtures thereof The salt of a polybasic organic acid, when used in conjunction with an alkali metal hydroxide, is selected from the group consisting of sodium gluconate, tetramethylammonium gluconate, sodium tartrate, tetramethylammonium tartrate, sodium citrate, potassium citrate, alkali metal salt of polyacrylic acid and mixture thereof The salt of a polybasic organic acid, when used in conjunction with a tetraalkylammonium hydroxide, is a tetramethyl ammonium carboxylate of organic acid selected from the group consisting of gluconic acid, tartaric acid, citric acid and polyarcylic acid.

The water based alkaline detergent solution, when used in conjunction with an alkali metal hydroxide, further comprises a corrosion inhibitor, a chlorine bleach compound or a combination thereof.

The water based alkaline detergent solution, when used in conjunction with an alkali metal hydroxide, further comprises an alkali metal salt selected from the group consisting of sodium metasilicate, potassium metasilicate, sodium tripolyphosphate, sodium carbonate, potassium carbonate, sodium sesquicarbonate, tetramethylammonium metasilicate, alkanolammonium metasilicate, and mixture thereof The alkanolamine is selected from the group consisting of ethanolamine, isopropanolamine, n-methylethanolamine, and mixture thereof the alkanolamine may be diethanolamine, triethanolamine, diethylene glycolamine, and mixtures thereof.

The water based alkaline detergent solution constitutes from about 1 weight percent to about 10 weight percent as active ingredients in water to provide a pH in the range from about 11.5 to about 14.0. The active ingredients consist of a mixture of an alkali metal hydroxide, an alkanolamine, a blend of non-ionic surfactant and amphoteric surfactant, and a polybasic organic acid salt in water.

The non-ionic surfactant is selected from the group consisting of ethoxylated alkyl phenols, biodegradable ethoxylated long chain linear alcohols, fluroalky ether surfactants, alkyl-polyglycosides and glucosamides of the lauryl n-methyl glucosamide. The ethoxylated alkyl phenols are selected from the group consisting of poly (oxyethylene-oxypropylene) nonyl phenyl ether and poly(oxyethylene) octylphenyl ether. The biodegradable ethoxylated long chain linear alcohols are selected from the group consisting of poly (oxyethylene) dodecyl ether, and poly (oxyethylene) sorbitan stearates.

The water based alkaline detergent solution further comprises an ionic surfactant selected from the group consisting of alkyl benzene sulfonic acid sodium salt, alkyl benzene sulfonic acid ammonium salt and ammonium salt. The ammonium salt is selected from the group consisting of dodecylbenzene sulfonic acid-sodium salt, dodecylbenzene sulfonic acid diethanolamine salt and triethanolamine salt. The ionic surfactant constitutes from about 0.05 weight percent to about 0.3 weight percent as active ingredients in said water based alkaline detergent solution.

Unlike organic solvent based cleaning methods described in the prior art, the aqueous cleaning method of this invention provides an environmentally safer option that has no problem of volatile air emissions and that poses no chemical safety issue associated with flammable solvents.

BRIEF DESCRIPTION OF THE DRAWINGS

The features of the invention believed to be novel and the elements characteristic of the invention are set forth with particularity in the appended claims. The Figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

The purposes of the present invention have been achieved by providing, according to the present invention, a method for cleaning a spin coating bowl assembly having a layer of polymer residue with aqueous alkaline detergent compositions.

Spin coating of photoresist films on silicon substrates is an essential step in the electronic device fabrication process sequence for semiconductor manufacturing. Deposition of polymer dielectric coatings, photosensitive polyimides, and polyimide insulator films on silicon or ceramic substrates by the spin coating technique is also a standard process step in microelectronic fabrication.

Figure 1:
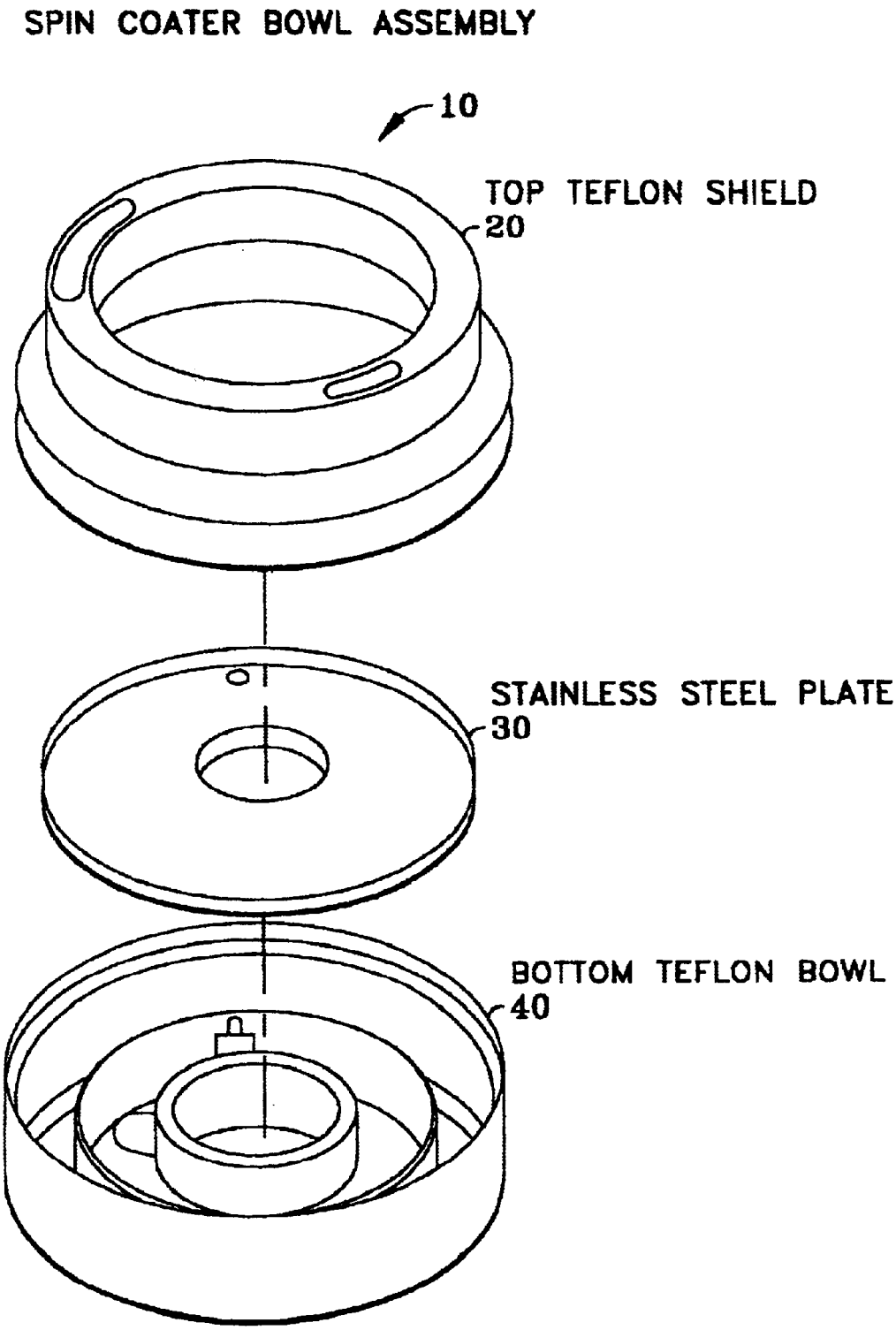
FIG. 1 is an exploded view of the spin coater bowl assembly parts.

Referring to the figures in more detail, and particularly referring to FIG. 1, there are shown various parts of a typical spin coater bowl assembly 10 used in advanced semiconductor device fabrication processes. This is a precision coating assembly comprising a machined teflon top shield 20, a stainless steel plate 30, and a bottom teflon bowl 40. The silicon device wafer (not shown) to be coated is held flat on a vacuum chuck (not shown) in the center of the bottom teflon bowl 40 by vacuum when a small volume of the photoresist formulation is dispensed on the wafer and spun at 2000 to 4000 RPM for 30 to 60 seconds or longer to form a uniform film on the wafer. In the spin coating process, only a small fraction of the solution is used up in forming the film on the wafer while a major portion of the dispensed solution splashes against the inside walls of the bottom teflon coating bowl 40 and other parts of the spin coater bowl assembly 10. With repeated use of the spin coater bowl assembly 10, the splashed polymer deposit on the bowl assembly builds to hundreds of microns thickness which, if not cleaned off, can flake off. The flying debris can land on the polymer film causing film defects and consequently product yield loss. Therefore, it is customary to clean all parts of the spin coater bowl assembly 10 which includes the machined teflon top shield 20, stainless steel plate 30, and the bottom teflon bowl 40, every 100 to 200 hours of use to assure a defect free film on the substrate.

Considering the limitations in the current practice of organic solvent-based cleaning of polymer spin coating bowl and assembly parts as described above, there is a need for an environmentally friendly low cost method of cleaning polymer residue from polymer apply equipment in both the semiconductor device and packaging fabrication process.

This invention provides an aqueous cleaning alternative to solvent-based cleaning of polymer spin coating bowls and associated accessories. Water-based cleaning compositions, according to this invention, are alkaline detergent formulations having a pH of about 11.5 to about 14 which are based on a combination of surfactants, an alkali metal hydroxide and/or a tetraalkyl ammonium hydroxide, alkanolamine, a carboxylate salt of a dibasic or a polybasic organic acid as gluconic acid, tartaric acid, citric acid, polyacrylic acid, and combination thereof the alkali metal hydroxide can be sodium hydroxide, potassium hydroxide, or a mixture thereof, and the preferred alkanolamines are of the type ethanolamine (2-aminoethanol), n-methylethanolamine, isopropanolamine and mixture thereof. Other alkanolamines and alkoxyalkanolamines that can optionally be used include, diethanolamine, triethanolamine, and diethylene glycolamine or 2-(2-aminoethoxy)ethanol. The tetraalkylammonium hydroxide can be tetramethyl ammonium hydroxide, tetraethyl ammonium hydroxide, hydroxyethyltrimethyl ammonium hydroxide, and related compounds. The aqueous cleaning composition according to this invention can also include sodium metasilicate, sodium tripolyphosphate (STPP), tetraalkyl ammonium metasilicate and alkanolamine metasilicate. In addition, the aqueous detergent solutions according to this invention may optionally include alkali metal carbonate and/or bicarbonate, or sodium sesquicarbonate; a chelating agent; a corrosion inhibitor; and a chlorine bleach compound such as dichloro-isocyanurate dihydrate. Various surface active agents useful for this invention include non-ionic surfactants which are well known in the art such as nonylphenol ethoxylates, and long chain alcohol ethoxylates, that are well known in the art, for example, ethoxylated alkyl phenols as poly (oxyethylene-oxypropylene) nonyl phenyl ether, poly-(oxyethylene) octylphenyl ether, and polyethoxylated long chain linear alcohols as poly (oxyethylene) dodecyl ether, alkylpolygycosides, glucosamides, ionic surfactants of the type sodium and/or ammonium salt of dodecyl benzene sulfonic acid, dodecyl benzene sulfosuccinate, triethanolammonium salt of dodecyl benzene sulfonic acid, sodium xylene sulfonate, and related compounds. Representative amphoteric surfactants found useful for the purpose of this invention include, for example, betaine derivatives of the type coco-imidopropyl betaine, oleyl betaine, sodium alkoxypropyl imino dipropionate, methyl alkyl imidazoline sodium salt and related amphoteric surfactants.

Preferred detergent formulations for the purpose of this invention comprise about 0.5% to about 5% solution (wt %) of about 5:1 to about 20:1 mixture (wt. ratio) of sodium hydroxide and ethanolamine (2-aminoethanol) in water containing 0.1% to 1% (wt %) based on total volume of solution) of a non-ionic surfactant, preferably poly (oxyethylene) octylphenyl ether-polyethyleneglycol, an amphoteric surfactant, preferably of the type alkyl betaine derivative as coco-imidopropylbetaine in an amount of about 0.05–0.5% (wt %), and optionally an ionic surfactant, preferably sodium and/or ammonium salt of dodecyl benzene sulfonic acid and/or triethanolammonium salt of dodecyl benzene sulfonic acid in an amount of about 0.05–0.3 wt %. In addition, these detergent compositions can also include sodium tripolyphosphate (STPP), alkali metal salt and/or tetramethylammonium salt of polyacrylic acid, and a corosion inhibitor.

Unless specifically stated otherwise, all material percentages are deemed to be weight percent (wt %).

Figure 2:
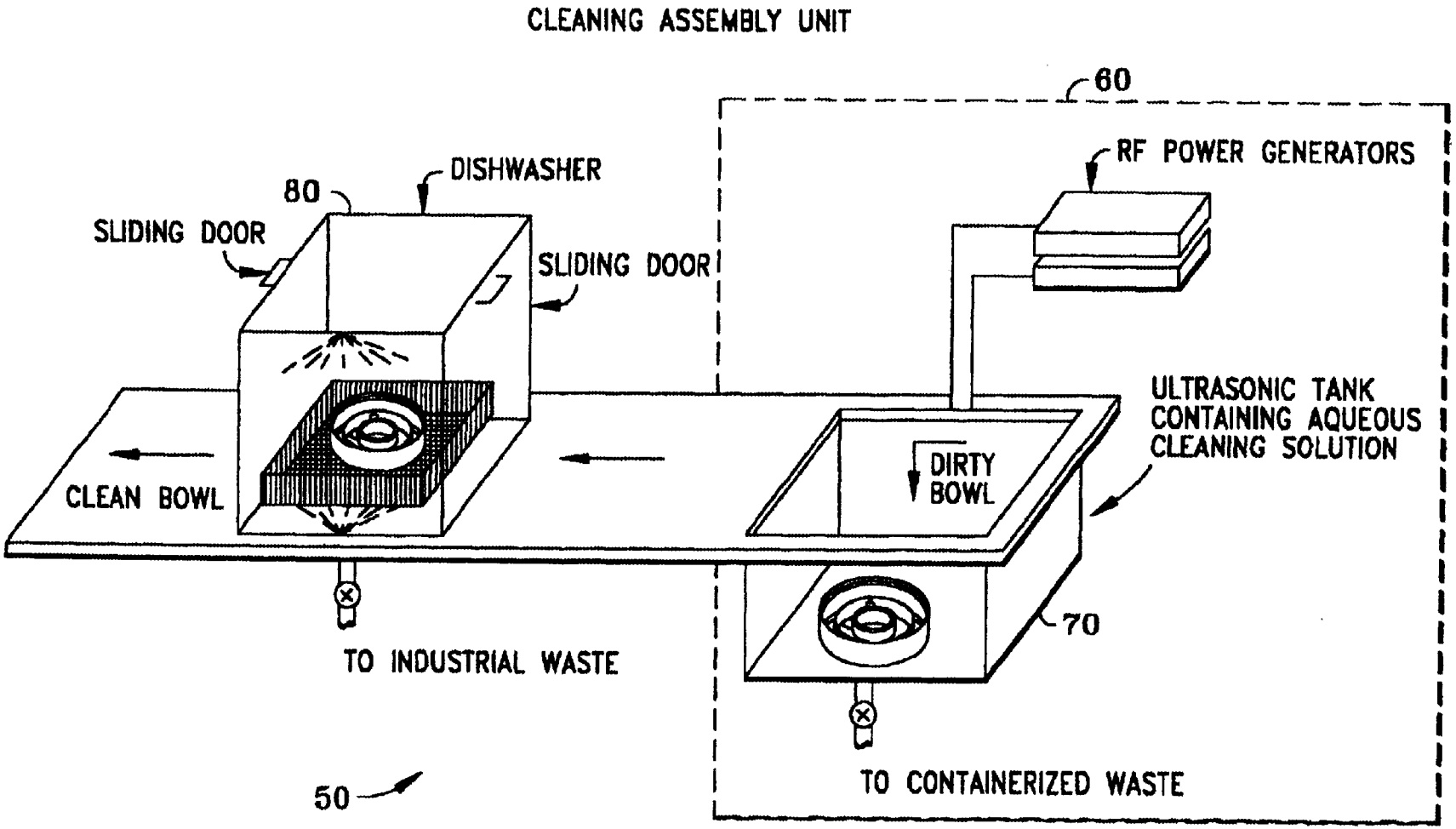
FIG. 2 is a schematic representation of the cleaning assembly unit.

Referring now to FIG. 2, there is shown a schematic representation of the cleaning assembly unit 50 which shows an ultrasonic tool 60 with stainless steel ultrasonic tank 70 for the cleaning cycle. A dishwasher unit 80 is used for pre-rinse wash, water rinse and a drying cycle. A preferred cleaning method involves immersion of various parts of the spin coater bowl assembly 10 in the cleaning solution pre-heated at about 120° F. to about 150° F. or higher, in the stainless steel ultrasonic tank 70, followed by ultrasonic agitation for 10 to 60 minutes which effects complete removal of wet polymer residue. Subsequently, the parts are transported into an attached dishwasher (Hobart model AM14) unit 80 for a pre-rinse wash cycle with about 4 gallons of a solution of about 0.2 wt % sodium hydroxide and 0.02 wt % of the non-ionic surfactant, Triton X-405 in water, followed by a pure water rinse and dry cycle. The pre-rinse wash solution is reused multiple times before discharging and substituting it with a fresh solution. Alternatively, if the polymer residue is essentially completely removed in the ultrasonic cleaning cycle, the pre-rinse wash can be skipped and the parts are directly subjected to the water rinse and drying cycle. It is found that if the photoresist or other polymer coating residue has dried out in the coater bowl due to solvent evaporation, it is generally preferred that the parts be pre-soaked in the cleaning solution in the ultrasonic tank without agitation for 30 minutes to 8 hours or soaked overnight at ambient temperature depending on the extent of dryness, and then subjected to ultrasonic agitation for 10 to 30 minutes or longer followed by the dishwasher cycle comprising water rinse cycle and dry.

A representative aqueous cleaning composition and method of cleaning a spin coating bowl assembly according to this invention is as follows:

The stainless steel ultrasonic tank 70 of the cleaning unit assembly 50 as shown in FIG. 2 is charged with 35 gallons of deionized water, 4.2 kg of 50% (wt %) sodium hydroxide solution in water, 220 grams of ethanolamine, and 570 grams of a non-ionic surfactant, preferably octylphenoxy polyethoxy ethanol-polyethyleneglycol (Triton X-405, 70% active in water), an amphoteric surfactant of the type coco-imidopropyl betaine in an amount of about 200 grams, and about 100 grams of polyacrylic acid sodium salt. The cleaning mixture is pre-heated to 130° F. 140° F. in the stainless steel ultrasonic tank 70 and one or more sets of coating bowl assembly parts (not shown) carrying photoresist and/or other polymer residue are immersed in the solution in the stainless steel ultrasonic tank 70, ultrasonics turned on, and agitation is maintained for 10 to 60 minutes depending on the thickness and the dryness of the polymer layer. Stainless steel parts of the bowl assembly take longer to clean depending on the thickness of the polymer deposit and the amount of solvent present in the polymer deposit. Stainless steel assembly parts carrying dried polymer residue are preferably soaked overnight at ambient temperature prior to ultrasonic agitation for 10 to 60 minutes. After the ultrasonic cleaning cycle, the parts are transported manually or with an automated robotic system to the attached dishwasher unit 80 where the bowl sets are subjected to a pre-rinse wash with 4 gallons of a water solution containing 0.2% (wt %) sodium hydroxide and 0.02% (wt %) of a non-ionic surfactant, preferably, Triton X-405 (70% active, Union Carbide), at approximately 140° F. for 2 to 10 minutes as necessary, followed by a deionized water rinse cycle with 0.5 to 1.0 gallon in the same dishwasher followed by drying. Alternatively, if the polymer residue is essentially completely removed in the ultrasonic cleaning cycle, the pre-rinse wash can be skipped and the parts are directly subjected to the water rinse and drying cycle.

Thus, ultrasonic cleaning, dishwasher pre-rinse, and wash with a dilute alkali solution, preferably containing a surfactant, followed by water rinse and drying of the parts, provides residue-free clean bowls and stainless steel assembly parts.

It is found that a 35 to 40 gallon charge of the cleaning solution can be used to clean up to 50 bowl assembly sets without impacting the cleaning performance of the solution. The number of bowl sets per batch being limited by the size of the ultrasonic tank. The pre-rinse wash solution described above may optionally include an amphoteric surfactant such as a coco-betaine in addition to the nonionic surfactant, a corrosion inhibitor, and carboxylate salt of organic acids such as citric, tartaric, gluconic acids, or polyacrylic acid sodium salt, an alkali metal phosphate such as sodium tripolyphosphate (STPP), sodium metasilicate, and mixtures thereof the aqueous cleaning solutions according to this invention may also be comprised of tetraalkyammonium hydroxide, typically tetramethyl ammonium hydroxide, nonionic surfactants, tetramethylammonium metasilicate and polyacrylic acid tetramethylammonium salt.

Advantages of the aqueous cleaning method described here compared to the commonly employed method for removing polymer residue deposits in spin coater bowls for photoresist and other polymer film deposition include: highly effective and efficient removal of residue from polymer coating equipment; no volatile air emissions; no chemical safety issues due to non-flammable water-based cleaning solutions; no VOC solvent contaminated waste and low cost water-based cleaning assembly unit comprising an integrated ultrasonic tool and a dishwasher which can be adapted to automated or batch mode cleaning. The relative wt % of the various active ingredients in the cleaning chemistry according to this invention can be varied to provide maximum cleaning efficiency for the type of residue to be removed. The pre-rinse solution and the rinse water from the dishwasher can be reused multiple times before discharging. The waste solution from the ultrasonic tank after multiple reuse is containerized and disposed of as it contains various types of polymer residues that are removed from the bowl assembly in the cleaning process.

EXAMPLES

Various aspects of the present invention are further illustrated by referring to the following examples which are intended only to further illustrate the invention and are not intended to limit the scope of the invention in any manner.

Example 1

Photoresist formulations coated on silicon device wafers using a standard spin coating bowl assembly are comprised of a matrix resin, typically phenolic resins as cresol novolak or poly (p-hydroxystyrene), a photoactive compound such as diazonaphthoquinone sulfonate ester, or functionalized poly (p-hydroxystyrene) carrying acid labile groups in conjunction with a photoacid generator, and silicone containing resists in solvents such as propylene glycolmonomethyl ether acetate (PGMEA), ethyl-3-ethoxypropionate (EEP), ethyl lactate, cyclohexanone, MIBK and related solvents. Other polymer coatings in microelectronics fabrication include: antireflective coatings, low dielectric constant polymers (low-k materials), polyimide formulations for spin coating application which are generally based on a polyamic acid or soluble polyimide in high boiling solvent such as 1-methyl-2-pyrrolidinone (NMP), gamma-butyrolactone, and propylene glycolmethyl ether (PGME), cyclohexanone, aromatic hydrocarbons, and mixtures thereof, for example.

(A)The ultrasonic tank was charged with 35 gallons of the aqueous cleaning solution containing 4.2 kg of 50 wt % solution of sodium hydroxide, 220 grams monoethanolamine, and 570 grams of 70% (wt %) active poly(oxyethylene) octyl phenyl ether (Triton X-405, Union Carbide), and 200 grams coco-imidopropyl betaine, about 100 grams of sodium gluconate and about 100 grams of polyacrylic acid sodium salt, balance being deionized water. The solution was preheated to 130° F. to 140° F. and one or more sets of spin coating bowl assembly parts, carrying photoresist residue at varying level of dryness depending on the volatility of the resist casting solvent used and the length of the time between coatings and bowl cleaning, were immersed in the solution and ultrasonically agitated at a 40 kHz frequency for about 25 to 30 minutes which caused complete removal of the residue. The spin coating bowls and assembly parts were then immediately transported to a dishwashing unit where they were subjected to a pre-rinse wash for 2 to 4 minutes with 4 gallons of water solution containing a 0.2 wt % sodium hydroxide and 0.02 wt % of 70% active Triton X-405, and 0.02 wt % polyacrylic acid sodium salt, followed by rinse cycle with 1 gallon of deionized water and then hot air dry. Examination of the bowls surface showed excellent cleaning with no trace of any residue on any part of bowls surface.

(B)Spin coating bowls carrying polyimide residue from PMDA-ODA type polyamic acid precursor which is derived from pyromellitic dianhydride-oxydianiline in NMP solution were cleaned with the cleaning solution described in example 1A above. With polyimide residue, the bowls were pre-soaked in the cleaning solution for 1 to 2 hours followed by ultrasonic cleaning for 25 to 60 minutes, and dishwasher cycle for pre-rinse wash with the same solution as in (A) above, water rinse, and dry. Examination of the bowls after the cleaning cycle showed complete cleaning of all bowl surfaces.

Example 2

(A) An aqueous cleaning formulation was prepared by mixing with 35 gallons of water in an ultrasonic tank, 4.4 kg of 50 wt % solution of sodium hydroxide, 300 grams mono-ethanolamine, 200 grams of sodium gluconic acid as 50 wt % solution in water, 570 grams of 70% (wt %) active non-ionic surfactant poly(oxyethylene) octyl phenyl ether (Triton X-405, Union Carbide), 100 grams of a second nonionic surfactant ethoxylated alcohol or alcohol ethoxylate, about 200 grams of an amphoteric surfactant of the type C12-15 alkoxypropyl imino dipropionate (alkali surfactant NM, Tomah Products), and about 100 grams of sodium tripolyphosphate (STPP). The solution was preheated to 120° F. to 150° F. and one or more sets of spin coating bowl assembly parts carrying photoresist residue on their inside walls were immersed in the solution and ultrasonically agitated at a 40 kHz frequency for about 20 to 30 minutes which caused complete removal of the residue. The bowls were then immediately transported to a dishwashing unit where they were subjected to a pre-rinse wash for 2 to 3 minutes with 4 gallons of water solution containing 0.2 wt % sodium hydroxide and 0.03 wt % of 70% active Triton X-405, followed by rinse with 1 gallon of deionized water and hot air dry. Examination of the bowls surface showed excellent cleaning with no trace of any residue on any part of the bowls surface.

The cleaning tank waste solution after multiple cleaning cycles is disposed of as containerized waste as it contains removed polymer residue in addition to the active ingredients of the cleaning solution. The pre-rinse wash solution that is used to remove the clearing solution carry-over on the bowls and assembly parts can also be used multiple times before discharge. The final rinse water contains negligible, if any, amount of organic contaminants and thus can be drain discharged.

Example 3

Removal of silsesquioxane polymer residue with aqueous alkaline solution: A cleaning solution was prepared by mixing with 1.5 gallons of water in an ultrasonic bath operated at 40 kHz frequency, 120 grams of a 50.0 wt % solution of sodium hydroxide, 10 grams ethanolamine, 50 grams 10.0 wt % solution of polyacrylic acid in water, 5 grams (70% active) of the non-ionic surfactant poly (oxyethylene) octyl phenyl ether (Triton X-405), and about 5 grams of sodium tripolyphosphate (STPP). The solution was preheated at 130° F. to 140° F. and a set of teflon and stainless steel test parts carrying residue of low-k material based on hydrogen silsesquioxane (HSQ) were immersed in the solution and ultrasonics turned on for 2 to 3 minutes. Rapid removal of the residue accompanied by frothing at both the teflon and stainless steel surfaces was observed. The parts were then removed from the bath immediately and spray rinsed with deionized water and dried.

While the present invention has been particularly described, in conjunction with specific preferred embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A method for the aqueous cleaning of polymer coating residue on a polymer spin coater bowl assembly having a plurality of material surfaces with at least one teflon surface and one metal surface coated with the said polymer residue, the method comprising the steps of using at least one water based alkaline detergent solution to remove said polymer residue from said polymer spin coater bowl assembly surfaces wherein said water bases alkaline detergent solution comprises at least one alkali metal hydroxide or tetraalkylammonium hydroxide, at least one alkanolamine, at least one combination of a non-ionic surfactant and an amphoteric surfactant, at least one polybasic organic acid or salt of polybasic organic acid, and water.

2. The method of claim 1 wherein the polymer spin coater bowl assembly comprises a teflon top shield, a stainless steel plate, and a bottom teflon bowl.

3. The method of claim 1 wherein the polymer residue is a photoresist.

4. The method of claim 1 wherein the polymer residue is a polyimide.

5. The method of claim 1 wherein the polymer residue is a polyamic acid.

6. The method of claim 1 wherein the polymer residue is a low dielectric constant polymer coating formulation selected from the group consisting of silsesquioxane polymer, hydrogen silsesquioxane polymer, flowable oxide polymer and mixtures thereof.

7. The method of claim 1 wherein the polymer residue is an antireflective coating formulation.

8. The method of claim 1 wherein the aqueous cleaning of polymer residue with the water based alkaline detergent solution comprises ultrasonic agitation at a temperature from between about 120° F. to about 150° F. or higher.

9. The method of claim 1 wherein said alkali metal hydroxide is selected from the group consisting of sodium hydroxide, potassium hydroxide, and mixtures thereof.

10. The method of claim 1 wherein said tetraalkylammonium hydroxide is selected from the group consisting of tetramethyl ammonium hydroxide, tetraethyl ammonium hydroxide, 2-hydroxyethyltrimethyl ammonium hydroxide, and mixture thereof.

11. The method of claim 1 wherein said non-ionic surfactant is selected from the group consisting of ethoxylated alkyl phenols, poly(oxyethylene) dodecyl ether, biodegradable graft co-polymers from mono or oligosaccharides, glucosamides, and mixtures thereof.

12. The method of claim 1 wherein said amphoteric surfactant is selected from the group consisting of coco-imidopropyl betaine, sodium alkoxypropyl iminodipropionate, methylalkyl imidazoline sodium salt and mixtures thereof.

13. The method of claim 1 wherein said polybasic organic acid is selected from the group consisting of gluconic acid, tartaric acid, citric acid, polyacrylic acid and mixture thereof.

14. The method of claim 1 wherein said salt of a polybasic organic acid is a tetramethyl ammonium carboxylate of organic acid selected from the group consisting of gluconic acid, tartaric acid, citric acid and polyarcylic acid.

15. The method of claim 1 wherein said water based alkaline detergent solution further comprises a corrosion inhibitor, a chlorine bleach compound or a combination thereof.

16. The method of claim 1 wherein said water based alkaline detergent solution further comprises an alkali metal salt selected from the group consisting of sodium metasilicate, potassium metasilicate, sodium tripolyphosphate, sodium carbonate, potassium carbonate, sodium sesquicarbonate, tetramethylammonium metasilicate, alkanolammonium metasilicate, and mixture thereof.

17. The method of claim 1 wherein said at least one alkanolamine is selected from the group consisting of ethanolamine, isopropanolamine, n-methylethanolamine, and mixture thereof.

18. The method of claim 1 wherein said alkanolamine is diethanolamine, triethanolamine, diethylene glycolamine, and mixture thereof.

19. The method of claim 3 wherein said water based alkaline detergent solution constitutes from about 1 percent to about 10 percent (wt %) as active ingredients in water to provide a pH in the range from about 11.5 to about 14.0.

20. The method of claim 19 wherein said active ingredients consist of a mixture of an alkali metal hydroxide, an alkanolamine, a blend of non-ionic surfactant and amphoteric surfactant, and a polybasic organic acid salt in water.

21. The method of claim 20 wherein said blend of non-ionic surfactant and amphoteric surfactant comprises from about 0.15 percent to about 1.5 percent (wt. %) of said water based alkaline detergent solution wherein the blend of non-ionic surfactant and amphoteric surfactant are in the ratio of about 2:1 to about 20:1 respectively.

22. The method of claim 1 wherein said alkali metal hydroxide and alkanolamine constitute from about 0.5 percent to about 5 percent (wt %) of said water based alkaline detergent solution, wherein said alkali metal hydroxide and alkanolamine are present in the ratio between 5:1 and 20:1 respectively.

23. The method of claim 1 wherein said tetraalkylammonium hydroxide and alkanolamine constitute from about 0.5 percent to about 5 percent (wt %) of said water based alkaline detergent solution, wherein said tetraalkylammonium hydroxide and alkanolamine are present in the ratio between 5:1 and 20:1 respectively.

24. The method of claim 1 wherein said water based alkaline detergent solution further comprises an ionic surfactant.

25. The method of claim 24 wherein said ionic surfactant is selected from the group consisting of alkyl benzene sulfonic acid sodium salt, alkyl benzene sulfonic acid combination thereof and ammonium salt.

26. The method of claim 25 wherein said ionic surfactant is selected from the group consisting of dodecylbenzene sulfonic acid-sodium salt, dodecylbenzene sulfonic acid diethanolamine salt and triethanolamine salt.

27. The method of claim 24 wherein said ionic surfactant constitutes from about 0.05 weight percent to about 0.3 weight percent as active ingredients in said water based alkaline detergent solution.

28. The method of claim 11 wherein said ethoxylated alkyl phenols are poly(oxyethylene-oxypropylene) nonylphenyl ether.

29. The method of claim 11 wherein said ethoxylated alkyl phenols are poly(oxyethylene-oxypropylene) octylphenyl ether.

30. A method for cleaning a spin coating bowl assembly having a layer of polymer residue coated on at least one teflon surface and one metal surface of said assembly comprising the following steps in the order named:

providing a water based alkaline detergent solution, pre-heating said water based alkaline detergent solution from about 120° F. to about 150° F. in an ultrasonic tank, immersing said spin coating bowl and assembly having a layer of polymer residue in said pre-heated detergent solution, applying ultrasonic agitation to said pre-heated alkaline detergent solution, transporting said spin coating bowl assembly from said ultrasonic tank to a dishwasher unit, applying a dishwasher cycle of pre-rinse wash with a dilute alkali and a surfactant solution, applying a water rinse cycle by spray wash, and drying the cleaned and rinsed spin coating bowl and assembly wherein said water based alkaline detergent solution comprises an alkali-metal hydroxide or tetraalkylammonium hydroxide, an alkanolamine, a polybasic organic acid or a salt of polybasic organic acid, and a combination of surface active agents and where said dilute alkali and surfactant solution for pre-rinse wash comprises between about 0.1 to about 0.3 weight percent of alkali metal hydroxide, tetraalkylammonium hydroxide and combination thereof and about 0.02 to about 0.1 weight percent of surface active agent.

31. The method of claim 20 wherein the amount of surface active agent is about 0.01 to about 0.1 weight percent.

32. The method of claim 30 wherein said combination of surface active agents consists of a non-ionic surfactant and an amphoteric surfactant in the ratio of about 2:1 to about 20:1 respectively.

33. The method of claim 32 wherein said non-ionic surfactant is selected from the group consisting of ethoxylated alkyl phenols, biodegradable ethoxylated long chain linear alcohols, fluroalky ether surfactants, alkylpolyglycosides and glucosamides of the lauryl n-methyl glucosamide.

34. The method of claim 33 wherein said ethoxylated alkyl phenols are selected from the group consisting of poly (oxyethylene-oxypropylene) nonyl phenyl ether and poly (oxyethylene)octylphenyl ether.

35. The method of claim 33 wherein and said biodegradable ethoxylated long chain linear alcohols are selected from the group consisting of poly (oxyethylene) dodecyl ether, and poly (oxyethylene) sorbitan stearates.

* * * * *